US006502525B2

(12) United States Patent
Burke

(10) Patent No.: US 6,502,525 B2
(45) Date of Patent: Jan. 7, 2003

(54) MARINE CARRIER

(76) Inventor: Roy David Burke, 1975 Regional RD #3, Enniskillen Ontario L0B1J0 (CA)

( * ) Notice: Subject to any disclaimer, the term of this patent is extended or adjusted under 35 U.S.C. 154(b) by 42 days.

(21) Appl. No.: 09/854,589

(22) Filed: May 15, 2001

(65) Prior Publication Data

US 2001/0039911 A1 Nov. 15, 2001

(51) Int. Cl.[7] ..... B63B 35/40; B63B 23/38
(52) U.S. Cl. ..... 114/259; 114/366
(58) Field of Search ..... 114/258, 259, 114/263, 365, 366, 368, 369, 373, 375, 44, 45

(56) References Cited

U.S. PATENT DOCUMENTS

| | | | | | |
|---|---|---|---|---|---|
| 1,116,761 | A | * | 11/1914 | Thompson | 114/366 |
| 2,398,274 | A | * | 4/1946 | Albert | 114/259 |
| 3,387,811 | A | * | 6/1968 | Adams, Jr. | 248/146 |
| 3,508,510 | A | * | 4/1970 | Frankel | 114/260 |
| 3,895,592 | A | * | 7/1975 | King | 114/45 |
| 4,601,606 | A | * | 7/1986 | Eason | 405/1 |
| 4,964,358 | A | * | 10/1990 | Sandrow | 114/368 |
| 5,184,913 | A | * | 2/1993 | Meriwether | 405/1 |
| 5,394,814 | A | * | 3/1995 | Rutter et al. | 114/45 |
| 5,483,912 | A | * | 1/1996 | Thomas | 114/259 |

FOREIGN PATENT DOCUMENTS

| | | | | |
|---|---|---|---|---|
| JP | 0024690 | * | 2/1986 | 114/259 |
| JP | 403010982 | * | 1/1991 | 114/259 |

* cited by examiner

*Primary Examiner*—S. Joseph Morano
*Assistant Examiner*—Andy Wright
(74) *Attorney, Agent, or Firm*—Birch, Stewart, Kolasch & Birch, LLP

(57) ABSTRACT

The carrier includes a cradle having an elongated spine and a number of ribs which are spaced along the length of the spine. The spine is pivotally attached to a larger boat such that an end of the spine may be raised or lowered. When the end of the spine has reached its lowermost extent, it is immersed in water and allows a smaller boat to be floated into the cradle. When the end of the spine is raised to its uppermost extent, the smaller boat is lifted entirely out of water. A hoist or actuator serves to raise and lower the end.

5 Claims, 3 Drawing Sheets

MARINE CARRIER

BACKGROUND OF THE INVENTION

This invention relates to marine carriers and more particularly to a carrier for small boats such as canoes, small outboard motor boats, personal water-craft such as sea-doos, sea-fleas and the like.

The marine carrier of my invention attaches to the stem of a boat and may be lowered into water for loading and unloading of a smaller boat. The smaller boat may be raised until it is entirely out of water and transported by the larger boat while the smaller boat remains out of the water.

Briefly the marine carrier of my invention comprises a cradle having an elongated spine and a number of ribs which are spaced along the length of the spine and which extend outwardly from opposite sides thereof. The spine is pivotally attached to a larger boat such that an end of the spine is movable upwardly and downwardly between lower and upper positions. The end of the spine when in the lower position is in water when the larger boat is afloat such that the smaller boat when also floating can be moved, while floating, into a location within the cradle in which the spine is beneath the smaller boat and the ribs are on opposite sides of the smaller boat. The end when in the upper position is above the water such that the smaller boat is entirely out of water. A hoist or actuator serves to raise and lower the end.

DESCRIPTION OF THE DRAWINGS

The marine carrier of the invention is illustrated in the attached drawings in which.

Like reference characters refer to like parts throughout the description of the drawings.

DESCRIPTION OF PREFERRED EMBODIMENTS

Figure 1:
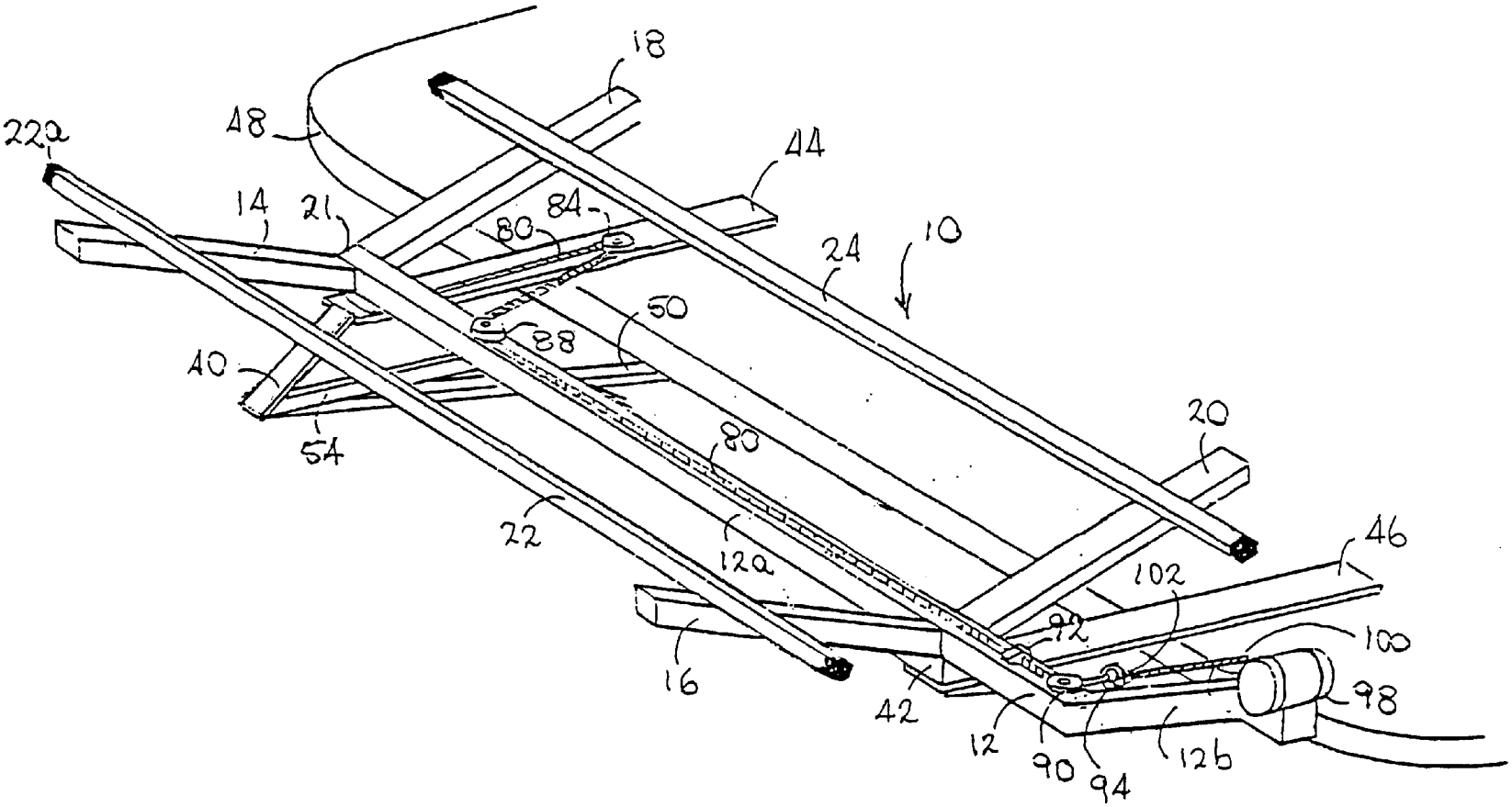
FIG. 1 is a perspective view of the carrier.

With reference to FIG. 1, the marine carrier of the invention includes a cradle, generally 10 having an L-shaped spine 12. The spine has a longitudinally extending component 12*a* and a laterally extending component 12*b*. A pair of spaced ribs 14, 16 extend laterally outwardly from one side of the spine and a like pair of ribs 18, 20 extend outwardly from the opposite side of the spine. As illustrated, ribs 14, 18 extend outwardly from the free or distal end 21 of the spine.

Stringers 22, 24 are spaced parallel and apart from the spine and are attached to each pair of ribs 14, 16 and 18, 20, respectively.

The cradle is mounted on a pair of spaced brackets 40, 42. The brackets have horizontally extending supports 44, 46 which are attached to and extend rearwardly from a swimming platform 48 at the rear of a water-craft used to transport a boat.

Figure 2:
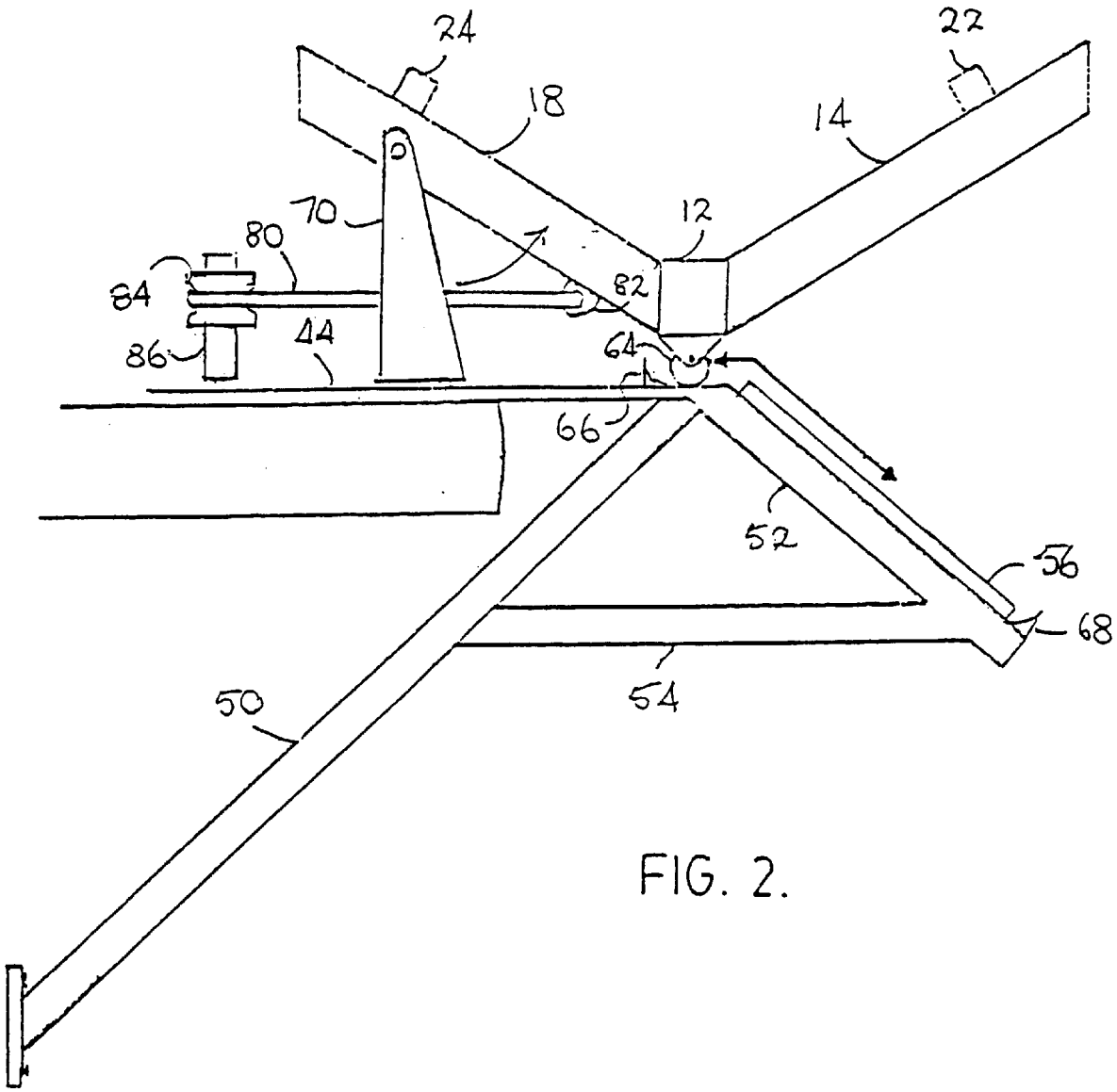
FIG. 2 is a side view of a first embodiment of the carrier.

With reference to FIG. 2, bracket 40 has a brace 50 which extends downward from the outer end of support 44 and connects to the transom (not illustrated) of the water-craft. The forward component 52 of the bracket extends downward from the outer end of the horizontal bar 44 at an angle of approximately 45 degrees from the vertical. The lower end of the forward component is supported by a horizontal strut 54 which extends to brace 50.

The bracket has a pair of parallel rails (one illustrated in FIG. 2 and marked 56) which define an elongated track or groove for rolling accommodation of a castor 64. The castor is mounted in bearings at the lower wall of spine 12 and rolls in the groove between an upper stop 66 at the outer end of the horizontal bar to a lower stop 68 at the lower end of rail 56.

A stay 70 is pivotally attached to rib 18 and has a lower wall which contacts bar 44 when the cradle is in the position illustrated in FIG. 2. The stay provides support for the cradle when it is in such position.

Figure 3:
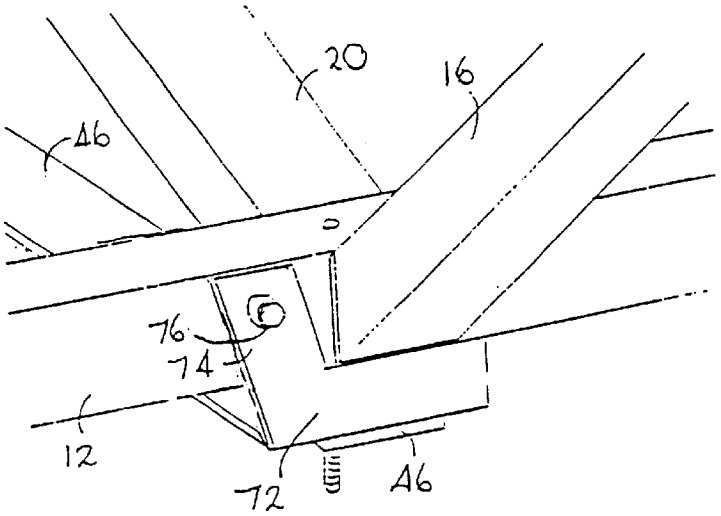
FIG. 3 is an enlarged fragmentary view of the swivel and the components connected to the swivel.

With reference to FIG. 3, an L-shaped plate 72 is attached to the outer end of horizontal support 46 and the plate has an upstanding wall 74 which is connected to spine 12 by means of stud 76. As illustrated, the stud extends through both the upstanding wall and the spine and serves as a swivel. By means of the swivel, the free end 21 of the spine (as illustrated in FIG. 1) is adapted to swing about the swivel between the upper and lower stops on the track.

With reference to FIGS. 1 and 2, a flexible first cable 80 is attached at 82 to rib 18. The cable extends around a pulley 84 which is attached to spindle 86 and around pulleys 88, 90 attached to the spine. A cleat 92 holds the cable adjacent to the spine and a ring 94 is attached to the end of the cable and prevents the cable from withdrawing from pulley 90.

A winch 98 is attached to the outer end of the laterally extending component 12*b* of the spine. A second cable 100 is wound around the winch and a hook 102 is attached to the free end of the cable for selective attachment to ring 94.

The operation of the marine carrier illustrated in FIGS. 1–3 is as follows. With reference first to FIG. 1, the end 22*a* of stringer 22 is pulled manually away from the water-craft so that the cradle will roll down the track. When ring 94 contacts pulley 90, the cradle will stop. The cradle should also be in contact with stop 68 at that point.

The free end 21 of the spine and the adjacent components of the cradle will then be in the water and the boat to be transported is positioned such at its bow is adjacent to the free end 21 of the spine.

The next step in the operation is to disconnect hook 102 from ring 94 and to activate the winch to unwind cable 100 until the hook reaches the bow ring of the boat. The hook is then attached to the bow ring.

The operation of the winch is the reversed to wind second cable 100 to draw the boat onto the cradle. The boat slides along stringers 22, 24 as the winch draws the boat onto the cradle. The stringers serve to guide the boat at this time so that the boat will be properly positioned in the cradle. When so positioned, the keel of the boat will be parallel to the spine of the cradle and either is in contact with it or is vertically above it.

When the bow of the boat reaches ribs 16, 20, the hook is removed from the bow rings of the boat and is attached to ring 94 at the end of the first cable 80. The winch is then activated to wind the cable thereby causing the castor to roll up the track on the bracket until the cradle reaches the position illustrated in FIG. 1. The castor will then be in contact with stop 66 and the boat will be out of water and be ready to be transported.

Stay 70 provides support to the cradle when it is out of the water in the position illustrated in FIG. 2. The stay minimizes damage to the cradle and to the boat when the transporting water-craft is in rough water.

Figure 4:
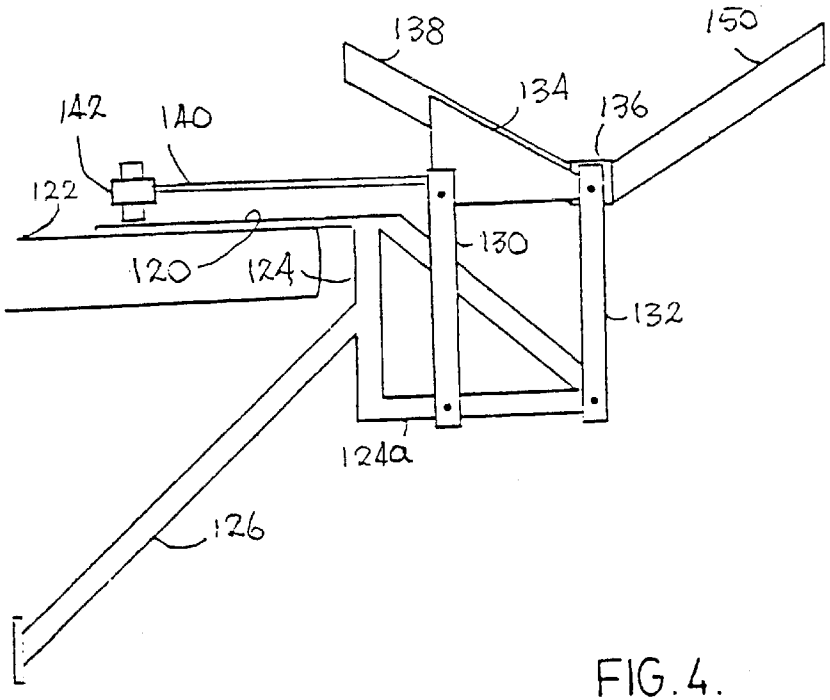
FIG. 4 is a side view of a second embodiment of the carrier.

The bracket illustrated in FIG. 4 can be substituted for the bracket illustrated in FIG. 2. With reference to FIG. 4, the bracket has a horizontal bar 120 which is attached to the swim platform 122. A triangular frame 124 is attached to the bar and a brace 126 interconnects the frame and the transom of the water-craft.

A pair of parallel spaced links 130,132 are pivotally attached to the lower horizontal component 124*a* of the frame and to plate 134 which is mounted to the spine 136 and to rib 138 of the cradle.

A cable 140 is attached to link 130 and extends around a pulley 142 and to a winch (not illustrated).

The operation of the bracket illustrated in FIG. 4 is as follows: The winch is first activated to unwind the cable. The outer end of rib 150 is pulled manually away from the water-craft to cause the links to rotate clockwise with resulting outward and downward movement of the cradle.

The end of the cradle illustrated in that Figure will then be in the water and the boat to be transported is drawn onto the cradle by means of the winch as before.

The winch is then attached to cable 140 and is activated to wind the cable thereby causing the links to rotate counterclockwise until they resume the position illustrated in that Figure. The boat will then be out of water and is ready to be transported.

It will be understood of course, that modifications can be made in the preferred embodiments illustrated and described herein without departing from the scope and purview of the invention. For example, the cradle may be raised and lowered by hydraulic or pneumatic pistons or actuators instead of a cable and winch. Other modifications may also be made in the structure of the marine carrier without departing from the scope of the invention.

I claim:

1. A marine carrier for supporting a smaller boat on a larger boat, said carrier comprising: a cradle having an elongated, spine and a plurality of ribs which are spaced along the length of said spine and which extend outwardly from opposite sides thereof, means for pivotally attaching said spine to said larger boat such that an end of said spine is movable upwardly and downwardly between lower and upper positions, said end when in said lower position adapted to be in water when said carrier is attached to the larger boat floating in water such that the smaller boat when also floating in water can be moved, while floating, into said cradle whereby said spine is beneath the smaller boat and said ribs are on opposite sides of the smaller boat, said end when in said upper position being above the water such that the smaller boat is entirely out of water, and means for selectively raising and lowering said end, further including a pair of stringers disposed parallel to said spine and being connected to the ribs on opposite sides thereof such that the stringers serve to guide the smaller boat as it floats into said cradle to ensure that said spine is beneath the smaller boat when the smaller boat is in said cradle and said ribs are on opposite sides of the smaller boat, and a bracket having means for connection to the larger boat and having a rail along which said end moves when moving between said lower and upper positions.

2. A marine carrier for supporting a smaller boat on a larger boat, said carrier comprising: a cradle having an elongated spine and a plurality of ribs which are spaced along the length of said spine and which extend outwardly from opposite sides thereof, means for pivotally attaching said spine to said larger boat such that an end of said spine is movable upwardly and downwardly between lower and upper positions, said end when in said lower position adapted to be in water when said carrier is attached to the larger boat floating in water such that the smaller boat when also floating in water can be moved, while floating, into said cradle whereby said spine is beneath the smaller boat and said ribs are on opposite sides of the smaller boat, said end when in said upper position being above the water such that the smaller boat is entirely out of water, and means for selectively raising and lowering said end, further including a pair of stringers disposed parallel to said spine and being connected to the ribs on opposite sides thereof such that the stringers serve to guide the smaller boat as it floats into said cradle to ensure that said spine is beneath the smaller boat when the smaller boat is in said cradle and said ribs are on opposite sides of the smaller boat, and a bracket having means for connection to the larger boat and having a pair of spaced links pivotally attached to-said bracket and to said cradle, said links being substantially vertically extending when said end is in said upper position and pivoting toward a horizontal position as said end moves to said lower position.

3. A marine carrier for supporting a smaller boat on a larger boat, said carrier comprising: a cradle having an elongated spine and a plurality of ribs which are spaced along the length of said spine and which extend outwardly from opposite sides thereof, means for pivotally attaching said spine to said larger boat such that an end of said spine is movable upwardly and downwardly between lower and upper positions, said end when in said lower position adapted to be in water when said carrier is attached to the larger boat floating in water such that the smaller boat when also floating in water can be moved, while floating, into said cradle whereby said spine is beneath the smaller boat and said ribs are on opposite sides of the smaller boat, said end when in said upper position being above the water such that the smaller boat is entirely out of water, and means for selectively raising and lowering said end, further including a pair of stringers disposed parallel to said spine and being connected to the ribs on opposite sides thereof such that the stringers serve to guide the smaller boat as it floats into said cradle to ensure that said spine is beneath the smaller boat when the smaller boat is in said cradle and said ribs are on opposite sides of the smaller boat, and including a support adapted to be attached to and to extend horizontally outward from the stern of the larger boat, a plate connected to said support and being pivotally connected to said spine, said support and said plate being above the water in which the larger boat floats such that when said end is in said upper position said spine is entirely above the water whereby said cradle serves to support the smaller boat entirely out of the water.

4. A marine carrier for supporting a smaller boat on a larger boat, said carrier comprising: a cradle having an elongated spine and a plurality of ribs which are spaced along the length of said spine and which extend outwardly from opposite sides thereof, means for pivotally attaching said spine to said larger boat such that an end of said spine is movable upwardly and downwardly between lower and upper positions, said end when in said lower position adapted to be in water when said carrier is attached to the larger boat floating in water such that the smaller boat when also floating in water can be moved, while floating, into said cradle whereby said spine is beneath the smaller boat and said ribs are on opposite sides of the smaller boat, said end when in said upper position being above the water such that the smaller boat is entirely out of water, and means for selectively raising and lowering said end, including a pair of stringers disposed parallel to said spine and being connected to the ribs on opposite sides thereof such that the stringers serve to guide the smaller boat as it floats into said cradle to ensure that said spine is beneath the smaller boat when the smaller boat is in said cradle and said ribs are on opposite sides of the smaller boat, wherein said means for selectively raising and lowering said end includes a cable to which said cradle is attached, and a winch for winding said cable with resulting raising of said end from said lower position to said upper position, wherein said cable is comprised of two selectively interconnectable lengths, a first said length being connected to said cradle and a second said length being connected to said winch, said second length being adapted to be selectively connectable to the smaller boat in order to move the smaller boat, while floating, into said cradle.

5. A marine carrier for supporting a smaller boat on a larger boat, said carrier comprising: a cradle having an elongated spine and a plurality of ribs which are spaced along the length of said spine and which extend outwardly from opposite sides thereof, means for pivotally attaching said spine to said larger boat such that an end of said spine is movable upwardly and downwardly between lower and upper positions, said end when in said lower position adapted to be in water when said carrier is attached to the larger boat floating in water such that the smaller boat when also floating in water can be moved, while floating, into said cradle whereby said spine is beneath the smaller boat and said ribs are on opposite sides of the smaller boat, said end when in said upper position being above the water such that the smaller boat is entirely out of water, and means for selectively raising and lowering said end, further including a pair of stringers disposed parallel to said spine and being connected to the ribs on opposite sides thereof such that the stringers serve to guide the smaller boat as it floats into said cradle to ensure that said spine is beneath the smaller boat when the smaller boat is in said cradle and said ribs are on opposite sides of the smaller boat, and a stay pivotally connected to one said rib and adapted to stabilize said cradle when said end is in the upper position.

* * * * *